United States Patent [19]

Wise

[11] Patent Number: 4,986,599

[45] **Date of Patent: * Jan. 22, 1991**

[54] BABY CARRIER

[75] Inventor: Robert D. Wise, Akron, Ohio

[73] Assignee: Century Products Company, Macedonia, Ohio

[ * ] Notice: The portion of the term of this patent subsequent to Jan. 6, 2004 has been disclaimed.

[21] Appl. No.: 471,685

[22] Filed: Jan. 26, 1990

Related U.S. Application Data

[63] Continuation of Ser. No. 356,972, May 24, 1989, abandoned, which is a continuation of Ser. No. 876,960, Jun. 20, 1986, abandoned, which is a continuation of Ser. No. 550,261, Nov. 8, 1983, Pat. No. 4,634,175.

[51] Int. Cl.[5] ..... A47D 1/00

[52] U.S. Cl. ..... 297/183; 297/377

[58] Field of Search ..... 297/183, 368, 369, 377, 297/363–367, 370–372

[56] References Cited

U.S. PATENT DOCUMENTS

| | | | |
|---|---|---|---|
| 199,505 | 1/1878 | Britton . | |
| 2,137,335 | 11/1938 | Gabb . | |
| 2,921,773 | 1/1960 | Hoelzer . | |
| 3,099,485 | 7/1963 | Beierbach . | |
| 3,361,473 | 1/1968 | Dodouyt . | |
| 3,409,325 | 11/1968 | Hamilton et al. . | |
| 3,492,047 | 1/1970 | Dudouyt . | |
| 3,804,459 | 4/1974 | Nose . | |
| 4,113,306 | 9/1978 | Von Wimmersperg . | |
| 4,231,612 | 11/1980 | Meeker | 297/250 |
| 4,324,432 | 4/1982 | Eldon | 297/377 |
| 4,371,206 | 2/1983 | Johnson Jr. | 297/183 |
| 4,634,175 | 1/1987 | Wise . | |

FOREIGN PATENT DOCUMENTS

| | | |
|---|---|---|
| 1555301 | 7/1970 | Fed. Rep. of Germany . |
| 843163 | 8/1960 | United Kingdom . |
| 2085817 | 5/1982 | United Kingdom . |

*Primary Examiner*—Peter R. Brown

*Attorney, Agent, or Firm*—Townsend and Townsend

[57] ABSTRACT

A baby carrier 10 having on its underside an integral pair of rockers 12 with a wedge shape pouch 13 detachable secured between the rockers, and having a support handle 14 rotatably connected to the sides of the carrier by a pair of pivots 15 which can be locked in various positions for use of the carrier to carry a baby, as a rocker, or as a chair.

4 Claims, 3 Drawing Sheets

BABY CARRIER

This is a continuation of Ser. No. 356,972, filed May 24, 1989 abandoned which is a continuation of U.S. Patent application Ser. No. 06/876,960, filed June 20, 1986, now abandoned which is a continuation of U.S. Patent application Ser. No. 06/550,261 filed Nov. 8, 1983 and now U.S. Pat. No. 4,634,175, issued Jan. 6, 1987.

BACKGROUND OF THE INVENTION

1. Field of the Invention

The present invention relates to baby carriers and particularly to one which can be used as a rocker, with a storage compartment and an improved handle.

2. Prior Art

Baby carriers have been designed in the prior art to sit on a floor at an adjustable angle and support a baby reclining on its back. U.S. Pat. No. 3,361,473 to Dudouyt teaches a chair having a seat and a back connected to legs by a clampable pivot, allowing the parts to be moved relative to each other. U.S. Pat. No. 3,492,047, also to Dudouyt, teaches a one-piece shell seat having a support including a front foot, a rear foot, and linkages, allowing the seat to be shifted to various angles or allowing the support to be shifted to the front of the seat to serve as a restraining cross bar. A one-piece shell seat, disclosed in U.S. Pat. No. D252,118 to Meeker, has a front foot, a rear foot, and braces, and apparently can be adjusted to different angles by a three-pronged gear. An infant's shell seat chair disclosed in U.S. Pat. No. 3,409,325 to Hamilton has a one-piece U-shaped support which swings around the top of the chair back for use as a carrying handle. The Hamilton chair has hinges comprising opposing disks each with radial teeth. Another seat hinge having radial teeth on opposing disks is disclosed in U.S. Pat. No. 3,099,485 to Beierbach. A hinge having parallel teeth on concentric barrels, not specifically for use in a chair, is disclosed in U.S. Pat. No. 2,921,773 to Hoelzer.

Another type of baby carrier is adapted for use as a rocker as well. For example, one type of available baby carrier, called the Kolkraft CARRI-CRADLE, uses rockers which are extensions of sides of the shell. Another type, sold by the Questor Corporation of Toledo, Ohio, as the MAXI-ROCKER, uses metal tubing attached to the sides and bottom of the shell.

Although the prior art baby carriers serve certain functions, several problems associated with baby carriers remain unsolved. For example, carrying a baby in a carrier makes it difficult to carry other items for the baby. There is a need, therefore, for a more versatile baby carrier which provides a more convenient means of carrying a baby and accessories.

SUMMARY OF THE INVENTION

The baby carrier of the present invention comprises a one-piece shell type seat having a generally U-shaped support rotatably attached to the sides of the shell by simple, reliable and convenient pivots. The bottom of the shell forms an integral pair of rockers allowing use of the carrier as a rocking cradle. The pivots can be locked in various predetermined positions, to serve various functions, for example, a carrying handle, folded compactly for storage, a stop for using the carrier as a napping rocker, or a prop for using the carrier as for feeding and playing. A detachable fabric carrying pouch is preferably provided beneath the carrier between the rockers for storing various items. The pouch does not interfere with other uses of the carrier and is very handy for carrying items when moving the cradle and baby about.

The present invention thus provides a baby carrier which is versatile—acting as a chair, a rocker or a one-handed carrier—through the use of the novel pivots. The pouch permits items to be conveniently carried along with the carrier and baby and yet allow unhindered use of the carrier as a chair or as a rocker.

DETAILED DESCRIPTION OF THE PREFERRED EMBODIMENT

Figure 1:
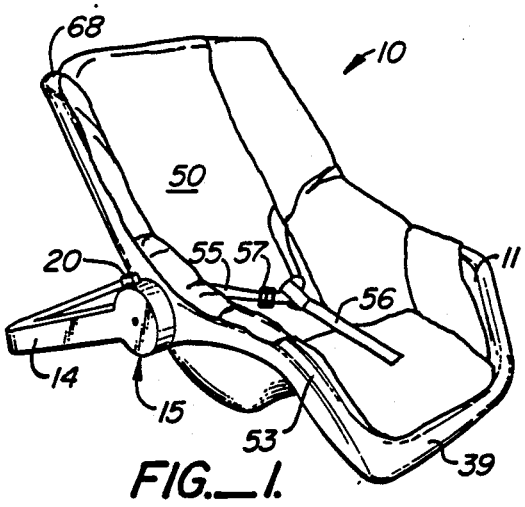
FIG. 1 is a front left perspective view of the baby carrier embodying the present invention.
Figure 2:
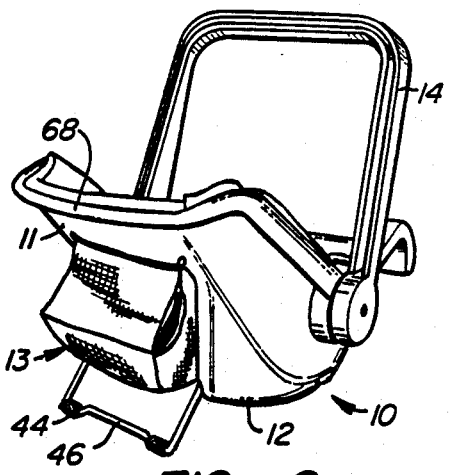
FIG. 2 is a rear left perspective view of the baby carrier.
Figure 3:
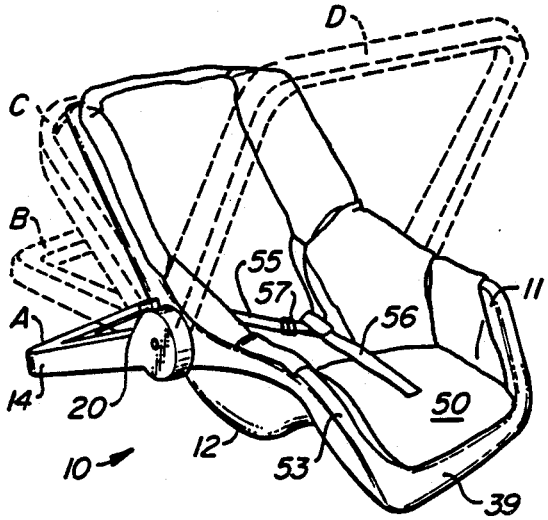
FIG. 3 is a perspective like FIG. 1 and showing the support in dotted outline in its various positions.

Referring to FIGS. 1 through 3, the present invention is a baby carrier 10 comprising a shell-type seat 11 having integral rockers 12, a separate storage pouch 13 suspended between rockers 12, and a rotatable support 14 connected by pivots 15 to shell 11. Pivots 15 can be locked in several predetermined orientations to facilitate different uses of the carrier. For example, as shown in FIG. 3, support 14 can be locked in position A to use carrier 10 as a seat for a baby to eat or play in, position B to use the carrier as a napping rocker, position C to store the carrier, and position D to carry a baby.

Figure 6:
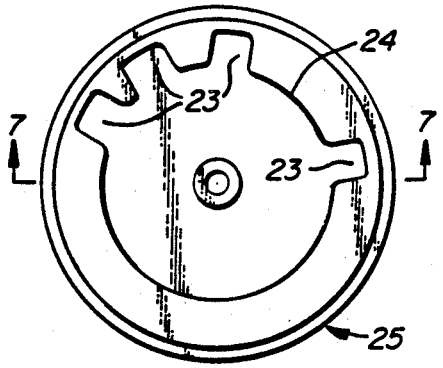
FIG. 6 is a view of the outward facing side of the left hub gear.
Figure 7:
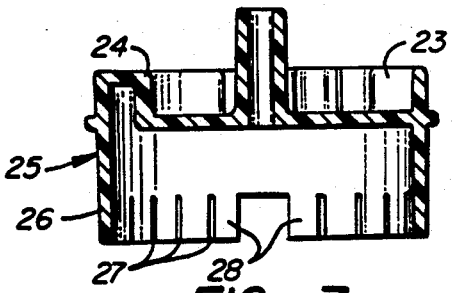
FIG. 7 is a cross-sectional side view of the left hub gear.
Figure 4:
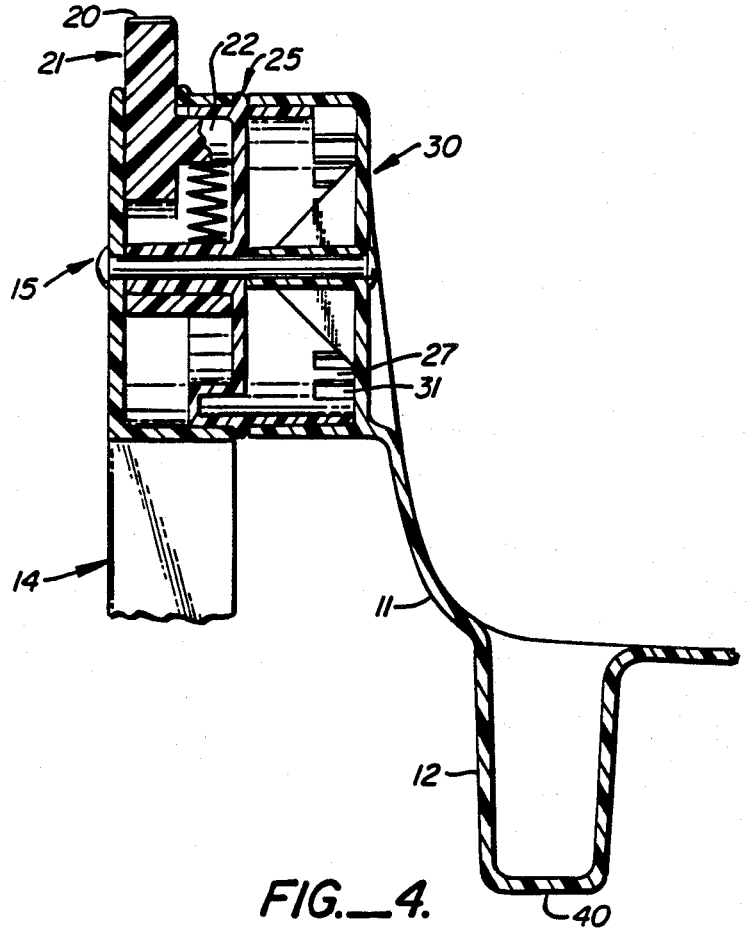
FIG. 4 is a front view cross-section taken through the left side of the seat shell, hub gear, plunger, and support hub cap.
Figure 5:
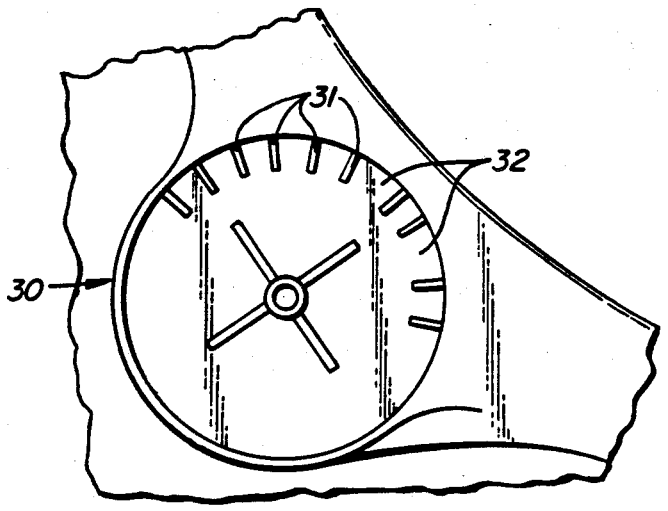
FIG. 5 is a left side elevation of the seat shell with the support and hub gear removed.
Figure 8:
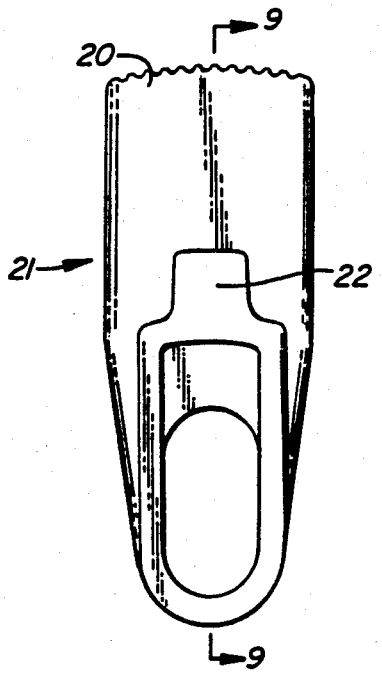
FIG. 8 is an elevation of the plunger.
Figure 9:
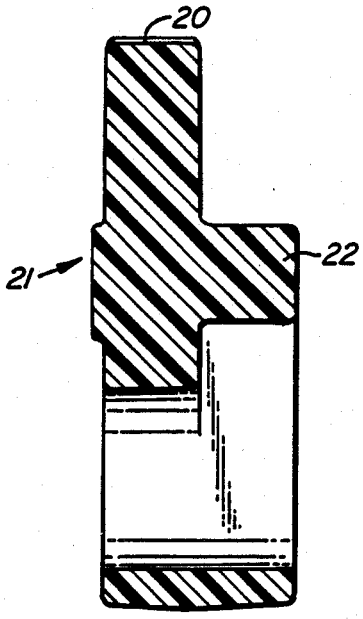
FIG. 9 is a cross-sectional side view of the plunger.

The support is positioned by pressing handle buttons 20 simultaneously with both hands, rotating support 14, and releasing the buttons to lock them. Referring to FIG. 4 a plunger 21 (FIGS. 8 and 9) holds support 14 in place, or permits it to rotate, through a plunger peg 22 interacting with notches 23 in the rim 24 of hub gear 25 (FIG. 6), which gear in turn is fixedly united with shell 11 through a second rim 26 (FIG. 7) interlocked with shell cup portion 30 (FIG. 5). Cup 30 has a series of radial tabs 31, interrupted by one or more gaps 32, and rim 26 has a series of parallel slots 27, interrupted by one or more unslotted arcs 28 (FIG. 7), allowing the second rim slots 27 to engage cup tabs 31 at the proper angle, but not otherwise. With hub gears 25 on both sides thus fixed at the correct orientation, notches 23 will also be correctly oriented to lock support 14 in the intended positions.

Near the foot 39 of carrier 10 each of the rockers 12 has, on its floor contacting bottom surface 40, a gripping pad 41 to stop the carrier from slipping when it is used as a chair with support 14 in position A.

Figure 10:
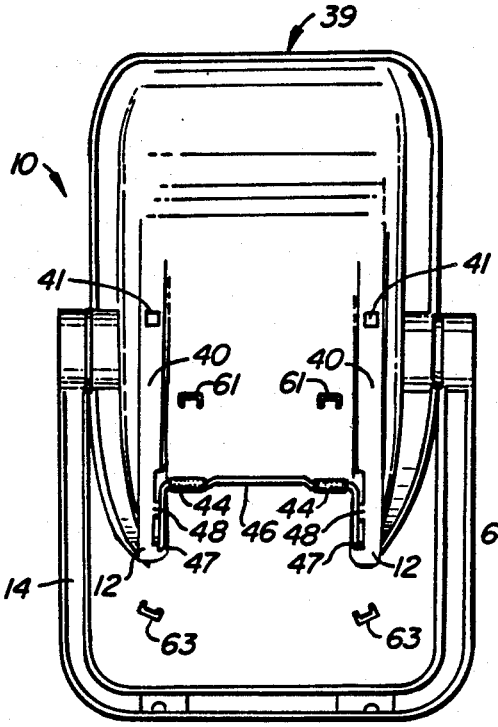
FIG. 10 is a bottom view with the pouch removed and showing the rockers.

A prop 46 (FIGS. 2 and 10), preferably heavy gauge metal wire, is rotatably mounted in a pair of holes 47, one in the inside of each of the rockers 12. Prop 46 can be clamped in a pair of clips 48 on the inside of respective rockers 12, or swung down and held by ridges (not shown) to prevent carrier 10 from rocking, regardless of the position of support 14. Prop 46 preferably has non-skid plastic sleeves 44.

The inside surface of shell 11 is lined with an upholstery pad 50 (FIGS. 1 and 3), preferably water repellent fabric or plastic. Pad 50 is anchored to arm rests 53 by fasteners (not visible), which may be plastic screws or clips, passing through holes in arm rest 53. The tops of the fasteners are preferably concealed under a top layer of pad 50. The fasteners are preferably removable to allow access to the facing surfaces of the shell and pad for cleaning with soap and water.

Seat 11 is also preferably provided with a waist strap 55 and a crotch strap 56, made for example of nylon webbing, and securable by a buckle 57 to prevent a baby from falling out of the carrier.

Figure 11:
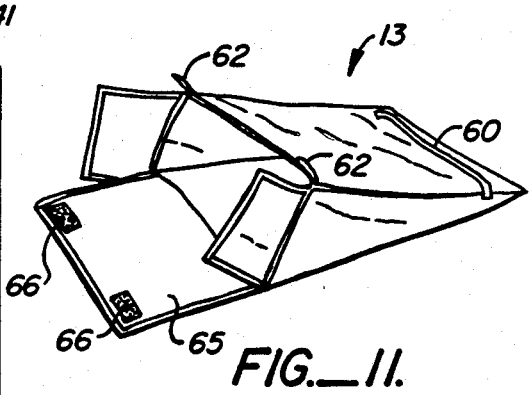
FIG. 11 is a view of the carrying pouch detached from the carrier.

On the underside of the shell, between rockers 12, a carrying pouch 13 (FIGS. 2 and 11) is preferably provided for convenience in storing and carrying various items. Pouch 13 is wedge shaped to fully occupy the space between the rockers, without interfering in chair or rocker movement of the carrier. Pouch 13 is detachably secured by a non-elastic tie 60 wrapped around plastic tabs 61 at the foot of the underside 45 of shell 11, and by elastic ties 62 which are stretched and hooked around plastic tabs 63 towards the head of underside 45. Pouch 13 has a closeable flap 65 which has Velcro TM strips 66 complementary to Velcro TM strips 67 on the opposite side of the pouch. Pouch 13 is preferably made of washable water resistant fabric so that it can be washed.

Details have been disclosed to illustrate the invention in a preferred embodiment of which adaptations and modifications within the spirit and scope of the invention will occur to those skilled in the art. The scope of the invention is limited only by the following claims.

What is claimed is:

1. In a baby carrier having a shell seat with sides and a rotatable handle, all bilaterally symmetrical about a lengthwise plane, a handle support pivot comprising:

a hub gear having a planar area disposed on the shell;

a rim extending from said planar area, and having a circumferential surface including a plurality of spaced apart notches;

a shaft extending from said planar area; and a cap at an end of said handle, secured to said shaft, including a drum portion for rotatable engagement about said rim, the drum portion comprising a plunger opening;

a spring; and a radially extending plunger disposed between said planar area and said cap and including:

an outer portion extending through said plunger opening;

an inner portion including a radially extending slot having a first portion through which said shaft extends and a second portion for retaining said spring between a boundary surface of the second portion and the shaft, wherein said second portion is axially offset from said first portion;

said second portion including a plunger peg positioned for mating engagement with said notches in said rim.

2. The baby carrier of claim 1 wherein the seat is a unitary shell seat.

3. The baby carrier of claim 2 wherein the U-shaped handle has distal ends and the first and second rotatable connectors connect the distal ends to the seat.

4. The baby carrier of claim 1 wherein the shaft is secured to the hub gear.

* * * * *